US007771082B2

(12) United States Patent
Peng et al.

(10) Patent No.: US 7,771,082 B2
(45) Date of Patent: Aug. 10, 2010

(54) LAMP WITH HEAT CONDUCTING STRUCTURE AND LAMP COVER THEREOF

(75) Inventors: Chang-Hung Peng, Chung-Ho (TW); Chung-Chin Huang, Chung-Ho (TW)

(73) Assignee: Cooler Master Co., Ltd., Taipei (TW)

( * ) Notice: Subject to any disclaimer, the term of this patent is extended or adjusted under 35 U.S.C. 154(b) by 72 days.

(21) Appl. No.: 12/100,162

(22) Filed: Apr. 9, 2008

(65) Prior Publication Data

US 2009/0141508 A1 Jun. 4, 2009

(30) Foreign Application Priority Data

Dec. 4, 2007 (TW) ..... 96220564 U

(51) Int. Cl.
*F21S 4/00* (2006.01)
*F21V 21/00* (2006.01)

(52) U.S. Cl. ..... 362/249.02; 362/294; 362/311.02; 362/345; 362/659; 362/800

(58) Field of Classification Search ..... 362/249.02, 362/294, 311.02, 345, 373, 652, 657–659, 362/800

See application file for complete search history.

(56) References Cited

U.S. PATENT DOCUMENTS

| | | | | |
|---|---|---|---|---|
| 6,848,819 | B1 * | 2/2005 | Arndt et al. | 362/545 |
| 7,549,774 | B2 * | 6/2009 | Tsai | 362/294 |
| 2009/0034283 | A1 * | 2/2009 | Albright et al. | 362/545 |

* cited by examiner

*Primary Examiner*—Jason Moon Han
(74) *Attorney, Agent, or Firm*—Chun-Ming Shih; HDLS IPR Services

(57) ABSTRACT

A lamp with heat conducting structure includes a lamp cover made of heat dissipating material. The lamp cover has a hollow configuration therein. An interlayer is horizontally arranged in the lamp cover. The lamp cover is divided into a first space and a second space therein by the interlayer. A LED lamp assembly is disposed in the first space of the lamp cover. A power plug is disposed in the second space of the lamp cover. The power plug has a control circuit board in the second space. The control circuit board has an electronic element disposed thereon. A heat conducting tab protrudes from the interlayer of the lamp cover towards the second space. The heat conducting tab has a heat conducting surface corresponding to the electronic element to thermally contact with the electronic element.

1 Claim, 4 Drawing Sheets

LAMP WITH HEAT CONDUCTING STRUCTURE AND LAMP COVER THEREOF

BACKGROUND

The present invention relates to an illumination apparatus, especially to a lamp with a heat conducting structure for heat dissipation.

Since the light emitting diodes (LEDs) have the advantages of consuming less electric power, providing a high light emitting efficiency and a long service life, the LEDs are widely employed in illumination of the electronic devices or lamps. A LED lamp is usually assembled together by a plurality of LEDs to enhance the emitting luminance and the emitting range. However, with the increase in the number of the assembled LEDs and the continuous developments of high efficiency LEDs, the heat generated by the LEDs is gradually increasing accordingly. Therefore, it is an important issue for those engaged in this art to provide a LED lamp that has a heat dissipating structure.

At present, the LED is used as light source of the lamp, without considering the heat dissipation problem of the LEDs with high efficiency, no heat dissipating method is provided for control circuit which is capable of transforming the alternating current to the direct current and electronic element thereof. Since the heat generated from these control circuits and the electronic element is not greater than the heat generated from the LEDs, no special heat dissipation request is needed generally. The heat generated from the control circuits and the electronic elements is not great, but when used in the lamp, heat will accumulate on the LED to raise the temperature thereof.

In view of the above, the inventor proposes the present invention to overcome the above problems based on his expert experiences and deliberate researches.

BRIEF SUMMARY

The present invention relates to a lamp with heat conducting structure and a lamp cover thereof. Based on the original heat dissipating structure of the lamp, the lamp with heat conducting structure and the lamp cover thereof of the present invention not only can dissipate heat from LED but also can provide heat dissipation to the control circuit board which is capable of transforming an alternating current into a direct current and the electronic elements thereon. This lamp and the lamp cover thereof can effectively avoid heat accumulating on the control circuit board to affect a service life of the LED.

The present invention relates to a lamp with heat conducting structure. The lamp includes a lamp cover made of heat dissipating material. The lamp cover has a hollow configuration therein. An interlayer is horizontally arranged in the lamp cover. The lamp cover is divided into a first space and a second space therein by the interlayer. A LED lamp assembly is disposed in the first space of the lamp cover. A power plug is disposed in the second space of the lamp cover. The power plug has a control circuit board in the second space. The control circuit board has an electronic element disposed thereon. A heat conducting tab protrudes from the interlayer of the lamp cover towards the second space. The heat conducting tab has a heat conducting surface corresponding to the electronic element to thermally contact with the electronic element.

The present invention also relates to a lamp cover with heat conducting structure. The lamp cover is made of heat dissipating material. The lamp cover has a hollow configuration therein. An interlayer is horizontally arranged in the lamp cover. The lamp cover is divided into a first space and a second space therein by the interlayer. A heat conducting tab protrudes from the interlayer of the lamp cover towards the second space. The heat conducting tab has a heat conducting surface for thermal contact.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
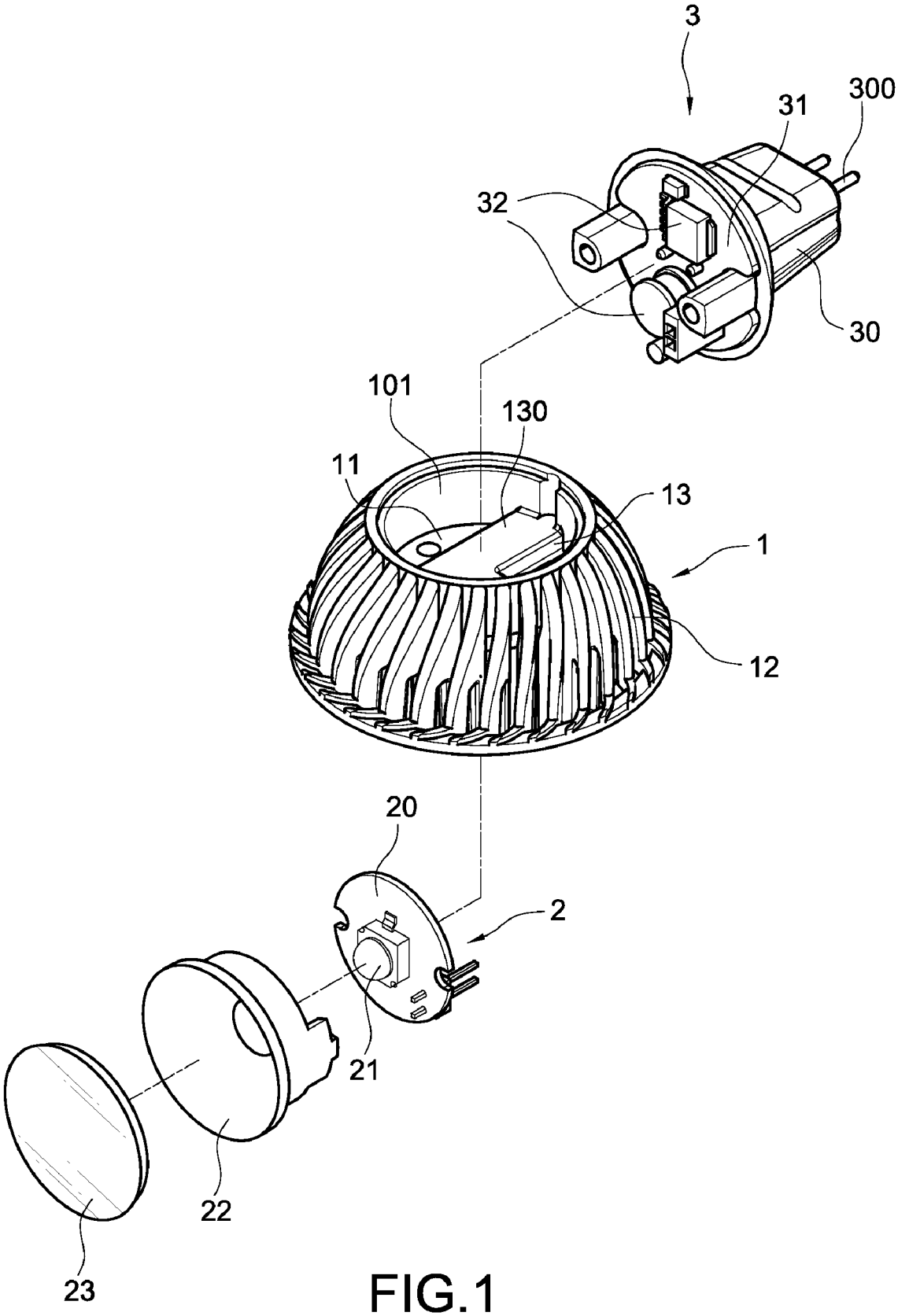
FIG. 1 is an exploded view of a lamp of an exemplary embodiment of the present invention.
Figure 2:
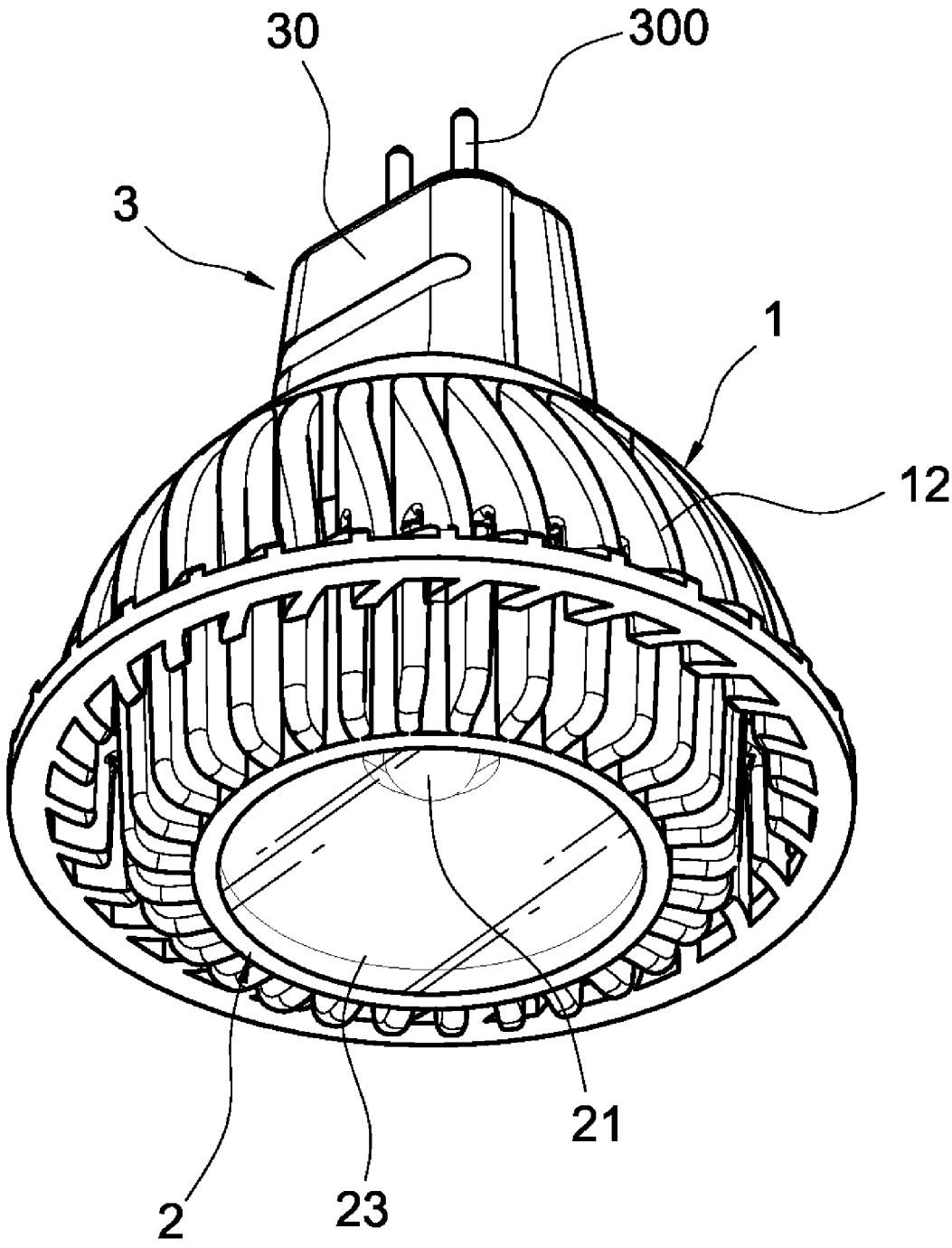
FIG. 2 is an assembled view of FIG. 1, but shown in another aspect.
Figure 3:
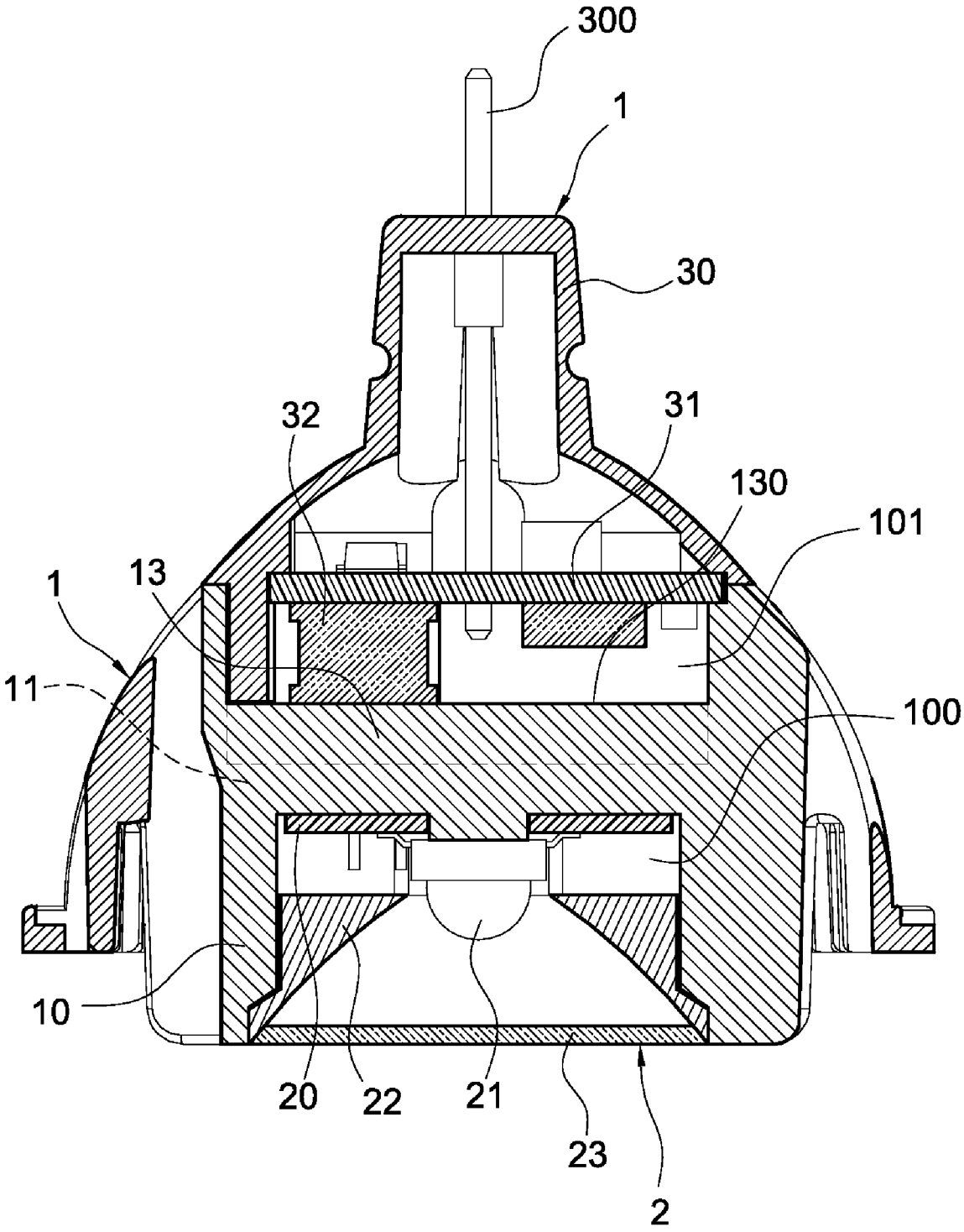
FIG. 3 is a sectional view of FIG. 1, but the lamp is assembled.

Referring to FIG. 1 to FIG. 3, the present invention relates to a lamp with heat conducting structure, the lamp includes a lamp cover 1, a LED lamp assembly 2 and a power plug 3. The lamp cover 1 is integrated formed by the material with good thermal conductivity. The lamp cover 1 has a cup-shaped body 10. The body 10 is hollow inside. An interlayer 11 is horizontally fixed in the body 10. The body 10 is divided into a first space 100 and a second space 101 by the interlayer 11. A mount of fins 12 extends out from an outer surface of the body 10 for dissipating heat.

The LED lamp assembly 2 is disposed in the first space of the body 10 of lamp cover 1. The LED lamp assembly 2 includes a circuit board 20, at least one LED 21 arranged on the circuit board 20, a light reflection shield 22 disposed around the at least one LED 21 and a lens 23 covered on the light reflection shield 22. The at least one LED 21 projects on the lens 23. A back side of the circuit board 20 is attached to the interlayer 11 of the body 10 of the lamp cover 1. The heat generated from the at least one LED 21 can be transferred by fins 12 on the body 10 of the lamp cover 1 through the contact of the circuit board 20 and the interlayer 11.

The power plug 3 is disposed in the second space 101 of the body 10 of the lamp cover 1. The power plug 3 has a connecting portion 30 protruding therefrom. A pair of plug terminals 300 protrudes from a front side of the connecting portion 30. A control circuit board 31 is fixed on a back side of connecting portion 30. The control circuit board 31 has one or more kinds of electronic elements 32 attached thereon for transforming an alternating current into a direct current. Heat can generate from the electronic elements 32.

The lamp cover 1 of the present invention not only can dissipate heat from LED 21 but also can provide heat dissipation to the electronic elements 32 of the control circuit board 31. One or more heat conducting tabs 13 protrude from the interlayer 11 of the lamp cover 1 towards the second space 101. In the present embodiment of the invention, one heat conducting tab 13 is provided. A heat conducting surface 130 is formed on the heat conducting tab 13 corresponding to the electronic elements 32 for contacting the electronic elements 32 to facilitate heat conduction. A kind of thermal interfacial material (such as heat conducting gasket, heat conducting cream and so on) can be attached onto the heat conducting surface 130 to fulfill the interspaces between the heat conducting surface 130 and the electronic elements 32 to enhance contact effect. Therefore, heat generated from the electronic elements 32 can be conducted to the fins 12 of the body 10 of the cover 1 through the heat conducting tab 13 by the contact of the heat conducting surface 130 and the electronic elements 32. The fins 12 not only can dissipate heat from LED 21 but also can provide heat dissipation to the electronic elements 32 of the control circuit board 31.

Figure 4:
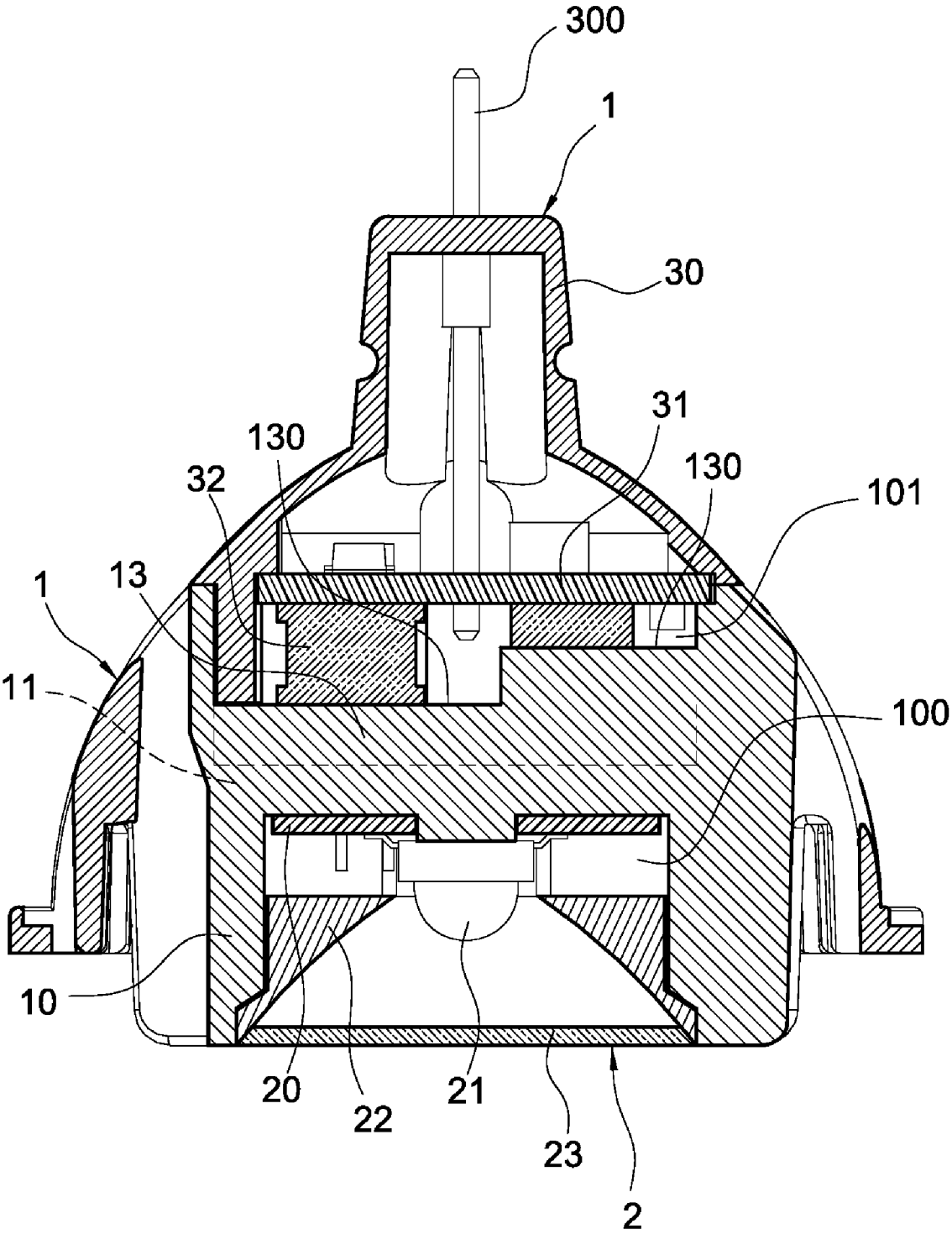
FIG. 4 is similar to FIG. 3, but shown a lamp of another exemplary embodiment of the present invention.

Referring also to FIG. 4, another exemplary embodiment is shown. The heat conducting surface 130 can be a step-shape configuration based on the different heights and different positions of the every electronic element 32 of the control circuit board 31. Therefore, the step-shaped conducting surface 130 can contact with the electronic elements 32 with different heights and different positions, so that the heat generated from the electronic elements 32 with different heights and different positions can be dissipated. A better heat dissipating effect is achieved.

Thus, in view of above, a lamp with heat conducting structure and a lamp cover thereof can be obtained.

The lamp with heat conducting structure and the lamp cover thereof of the present invention not only can dissipate heat from LED 21 but also can provide heat dissipation to the control circuit board 31 which is capable of transforming an alternating current into a direct current and the electronic elements 32 thereon. This lamp and the lamp cover thereof can effectively avoid heat accumulating on the control circuit board 31 to affect a service life of the LED 21. The whole temperature of the lamp can be effectively reduced simultaneity.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A lamp with heat conducting structure comprising:

a lamp cover defining a cavity therein;

a LED lamp assembly and a power plug are disposed within the cavity; and a plurality of fins extending along an outer surface of the lamp cover to encircle both the LED lamp assembly and the power plug therein;

wherein the lamp cover further comprises an interlayer to divide the cavity into first and second spaces for disposing the LED lamp assembly and the power plug, respectively, and wherein the power plug further comprises a control circuit board and a plurality of electronic elements on the control circuit board, the electronic elements have different heights and the interlayer has an extended surface configured to contact with the electronic elements at the different heights.

* * * * *